US006886279B2

(12) United States Patent
Kimble

(10) Patent No.: US 6,886,279 B2
(45) Date of Patent: May 3, 2005

(54) LOADER COUPLER WITH ADJUSTABLE DUMP AND ROLL-BACK STOPS

(75) Inventor: Allen E. Kimble, Rock Spring, GA (US)

(73) Assignee: JRB Company, Inc., Akron, OH (US)

( * ) Notice: Subject to any disclaimer, the term of this patent is extended or adjusted under 35 U.S.C. 154(b) by 11 days.

(21) Appl. No.: 09/999,868

(22) Filed: Oct. 23, 2001

(65) Prior Publication Data

US 2002/0085877 A1 Jul. 4, 2002

Related U.S. Application Data

(60) Provisional application No. 60/242,635, filed on Oct. 23, 2000.

(51) Int. Cl.[7] ..... E02F 3/36

(52) U.S. Cl. ..... 37/468; 37/903; 414/724; 403/24

(58) Field of Search ..... 37/468, 903; 172/272, 172/275; 414/723; 403/24

(56) References Cited

U.S. PATENT DOCUMENTS 4,708,579 A * 11/1987 Baird et al. ..... 414/723
4,768,917 A * 9/1988 Garman ..... 414/697
5,529,419 A * 6/1996 Gebauer ..... 37/468 X
5,692,850 A * 12/1997 Kimble et al. ..... 37/468 X
5,974,706 A * 11/1999 Kaczmarski et al. ..... 37/468
5,983,535 A * 11/1999 Kaczmarski et al. ..... 37/468
6,163,989 A * 12/2000 Kaczmarski et al. ..... 37/468

* cited by examiner

*Primary Examiner*—Christopher J. Novosad
(74) *Attorney, Agent, or Firm*—Fay, Sharpe, Fagan, Minnich & McKee, LLP

(57) ABSTRACT

A loader coupler includes first and second dump stops located on opposite lateral sides of the coupler and first and second roll-back stops located on opposite lateral sides of the coupler. Each of the dump and roll-back stops includes a base connected to or formed as a part of the coupler; at least one shim located adjacent the base; and, a cover releasably connected to the base and located adjacent the at least one shim. Accordingly, the at least one shim is located between the cover and the base. The outer face of the cover can be angled to ensure flush contact between it and an associated arm of a loader to which the coupler is connected. The adjustable stops are used by locating at least one shim adjacent the base and securing the a cover to the base member and adjacent the shim, with the shim located between the cover and the base member. Thereafter, it is determined if the cover contacts the associated loader arm in a desired stop position. If the cover does not contact the associated loader arm in the desired stop position, the position of the cover relative to the base is adjusted by changing the number of shims located between the cover and the base and/or changing the thickness of the shim. An angle of contact between an outer face of the cover and the associated loader arm can also be adjusted.

20 Claims, 5 Drawing Sheets

LOADER COUPLER WITH ADJUSTABLE DUMP AND ROLL-BACK STOPS

CROSS-REFERENCE TO RELATED APPLICATION

This application claims priority from and hereby expressly incorporates by reference U.S. provisional application No. 60/242,635 filed Oct. 23, 2000.

BACKGROUND OF THE INVENTION

The present invention relates generally to the art of heavy machinery and, more particularly, to the art of couplers for loader buckets and the like as used on wheel loaders, tractor loader backhoes and the like. Examples of such couplers are disclosed in commonly assigned U.S. Pat. Nos. 4,708,579, 5,529,419 and 5,692,850, the disclosures of which are hereby expressly incorporated by reference.

It is known to equip couplers for loader buckets and the like with stops that engage the arms or other fixed portion of the associated machinery to prevent further pivoting movement of the coupler and, thus, the bucket connected thereto relative to the arms or other fixed structure. For example, couplers for loader buckets typically include a pair of dump stops located on opposite lateral sides of the coupler and adapted to engage the loader arms and prevent pivoting movement of the bucket in a first direction beyond a predefined dump position. Likewise, these couplers include a pair of roll-back stops located on opposite lateral sides of the coupler and adapted to engage to loader arms and prevent pivoting movement of the bucket in an opposite, second direction beyond a predefined roll-back position. These stops are fixedly secured to the coupler body by welding and are not adjustable.

These prior, fixed stops are deficient in many respects. First, due to manufacturing tolerances and tolerance build-up, oftentimes the stops do not engage the loader arms as desired. Secondly, while the stops may perform perfectly on a first loader or other apparatus carrying the coupler, the stops may not be properly positioned for a different loader or other apparatus. Thus, a need has been identified for a coupler including adjustable dump and roll-back stops.

SUMMARY OF THE INVENTION

In accordance with a first aspect of the present invention, a loader coupler comprises first and second dump stops located on opposite lateral sides of the coupler, and first and second roll-back stops located on opposite lateral sides of the coupler. Each of the dump and roll-back stops comprises a base, at least one shim located adjacent the base, and a cover releasably connected to the base and located adjacent the at least one shim, whereby said at least one shim is located between said cover and said base. In one embodiment, the outer face of the cover is angled to provide flush contact between it and an associated arm of a loader to which the coupler is connected.

In accordance with another aspect of the present invention, an adjustable stop assembly for an associated loader coupler includes a base connected to the associated loader coupler and a cover releasably connected to the base. At least one shim is located between the base and the cover. An outer face of the cover is arranged at an angle relative to an inner face to ensure flush contact of the cover with an associated arm or other portion of the loader carrying the associated coupler.

In accordance with another aspect of the present invention, a method of providing an adjustable stop for a loader coupler includes locating at least one shim adjacent a base member connected to said coupler and securing a cover to the base member and adjacent the at least one shim with the at least one shim located between the cover and the base member. Thereafter, it is determined if the cover contacts an associated arm of an associated loader in a desired stop position. If the cover does not contact the associated arm of the associated loader in the desired stop position, the position of the said over relative to the base is adjusted by changing the number of shims located between the cover and the base and/or changing the thickness of the at least one shim. In accordance with a further aspect of the invention, an angle of contact between an outer face of the cover and the associated arm of the associated loader is adjusted.

Numerous benefits and advantages of the present invention will occur to those of ordinary skill in the art to which the invention pertains upon reading this specification.

BRIEF DESCRIPTION OF THE DRAWINGS

The invention comprises a variety of components and arrangements of components, preferred embodiments of which are illustrated in the accompanying drawings that form a part of this specification and wherein.

DETAILED DESCRIPTION OF THE PREFERRED EMBODIMENT

Figure 1:
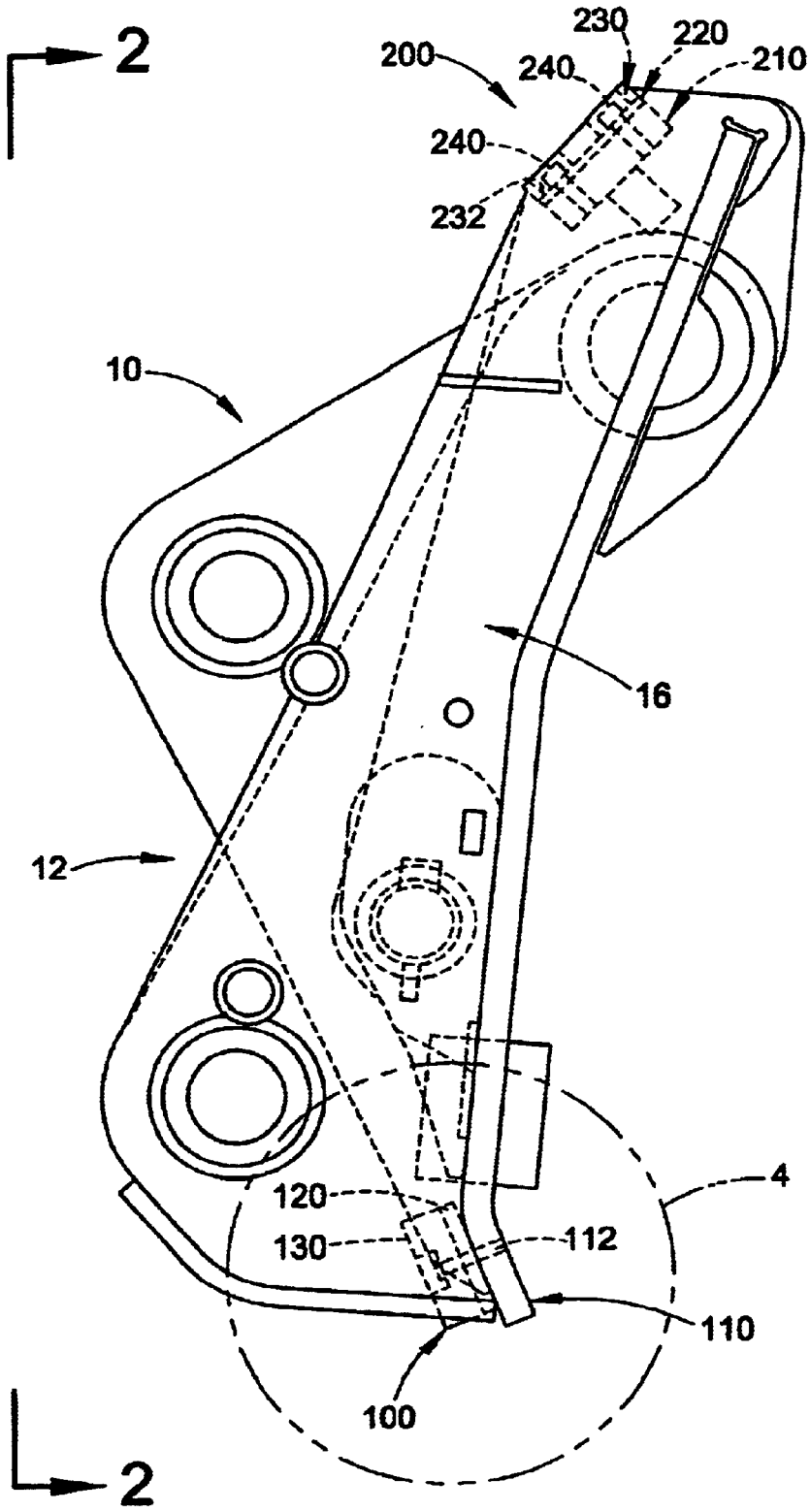
FIG. 1 is a side elevational view of a loader coupler with adjustable dump and roll-back stops formed in accordance with the present invention.
Figure 2:
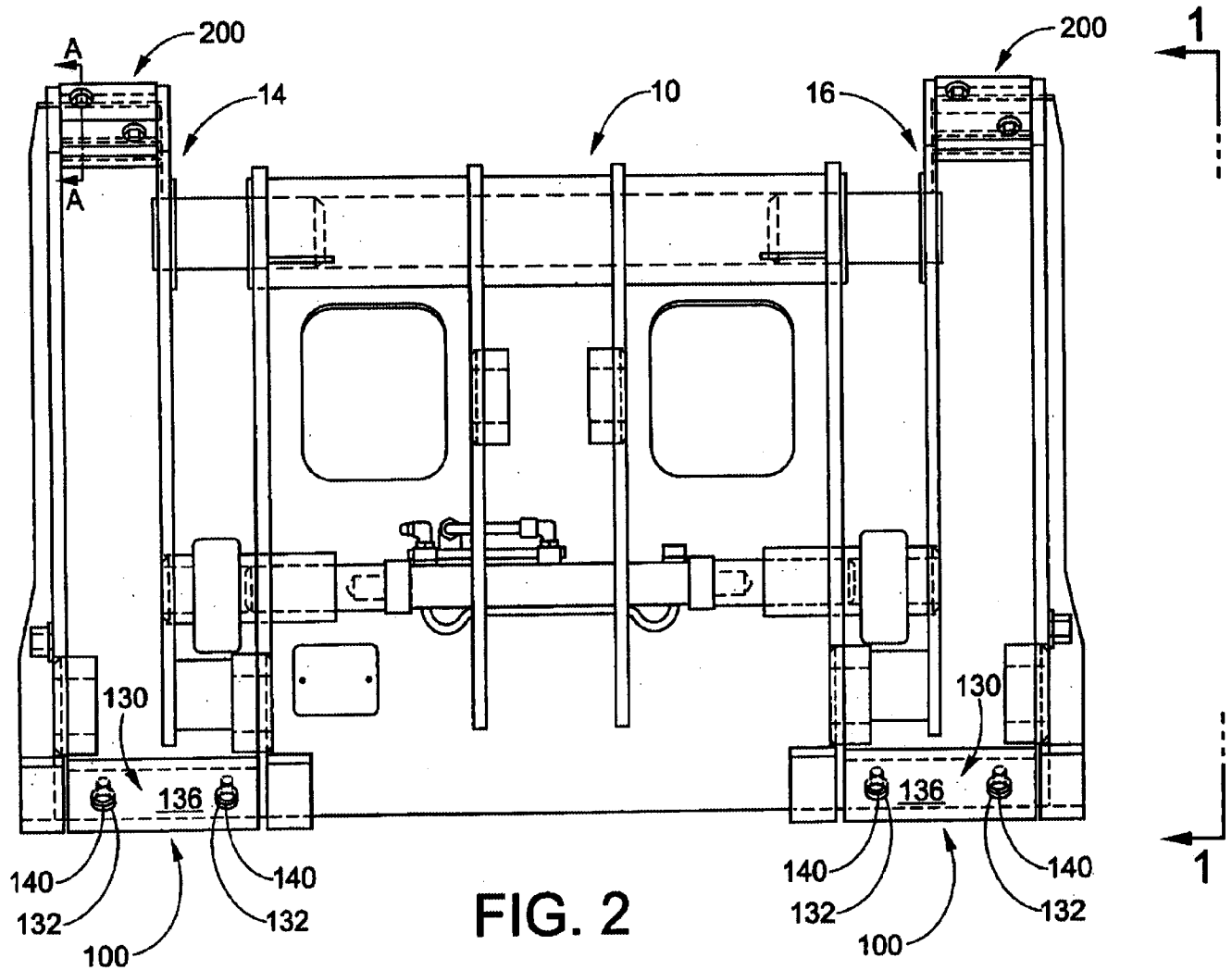
FIG. 2 is a rear elevational view of the loader coupler of FIG. 1 as taken along line 2—2 of FIG. 1.

FIGS. 1 and 2 illustrate a loader coupler 10 that is conventional in all respects except that it is equipped with adjustable dump stops 100 and adjustable roll-back stops 200 formed in accordance with the present invention. The dump stops 100 are located on a rear face or portion 12 (the face oriented toward the loader or other associated machine carrying the coupler 10) of the coupler 10 on opposite lateral sides 14,16 thereof. Likewise, the roll-back stops 200 are located on a rear face of the coupler 10 on its opposite lateral sides. Those of ordinary skill in the art will recognize that the dump and roll-back stops are located in positions that correspond to the location of conventional dump and roll-back stops, respectively. For simplicity and ease of understanding the invention, only one dump stop 100 and one roll-back stop 200 (those located on the second lateral side 16 of the coupler 10) are described in detail below. Those of ordinary skill in the art will recognize that the dump and roll-back stops located on the opposite lateral side 14 of the coupler 10 are identical or substantially identical. Also, unless otherwise specified, the components of the coupler 10 and stops 100,200 are defined from steel or another suitable durable metal or alloy.

Figure 4:
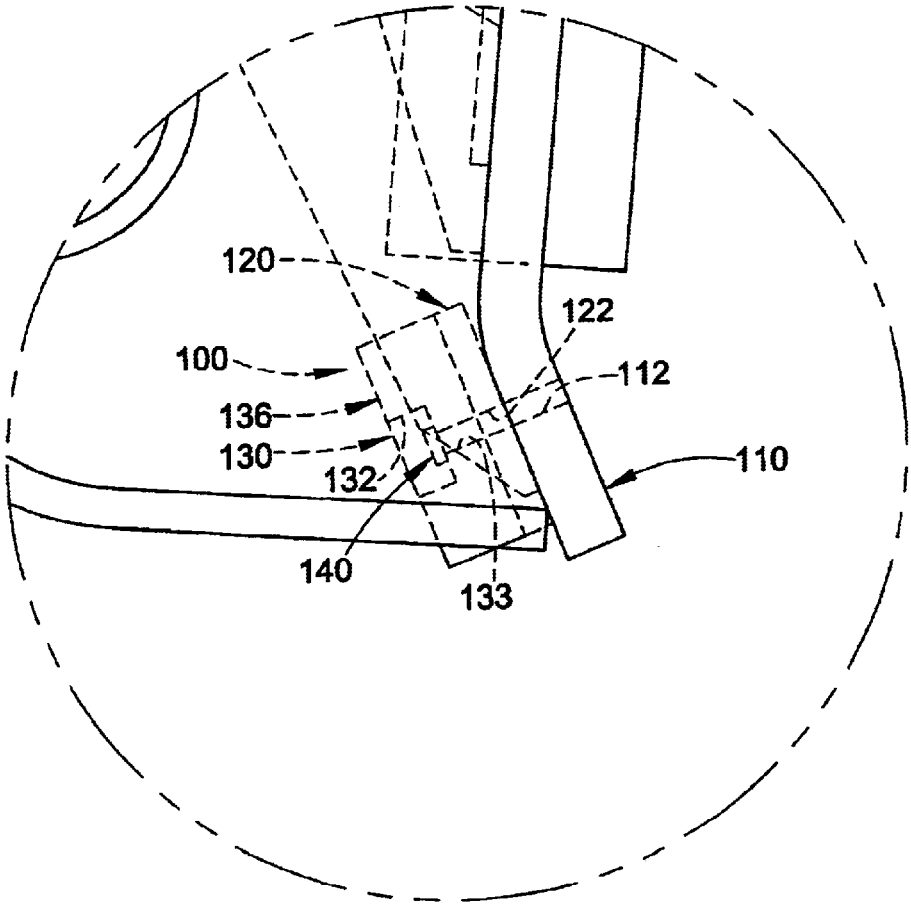
FIG. 4 is an enlarged portion of FIG. 1 showing a dump stop formed in accordance with the present invention.
Figure 5A:
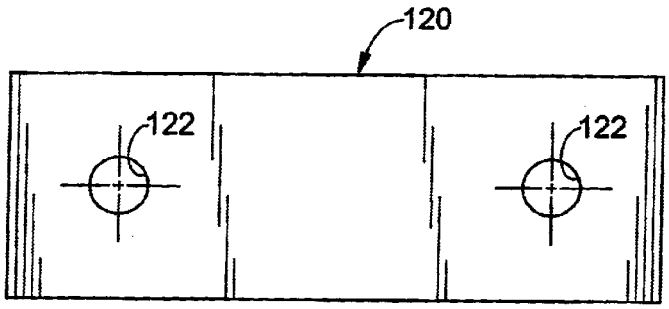
FIGS. 5A and 5B are plan and side elevational views, respectively, of a dump stop shim formed in accordance with the present invention.
Figure 5B:
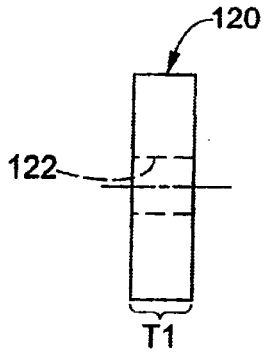

With reference to FIG. 4, the dump stop 100 comprises a dump stop base 110 that is welded to or otherwise integral with or defined as a one-piece construction with the coupler 10 or a base plate thereof and that defines at least one threaded bore 112 (only one shown in FIG. 1). One or more shims 120 of varying desired thickness are operatively positioned adjacent the dump stop base 110. A shim 120 formed in accordance with the present invention is shown in FIGS. 5A and 5B. The shim 120 defines a thickness T1 and first and second through-bores 122 (not threaded) that are located so that, when the shim 120 is operatively placed adjacent the dump stop base 110, the bores 122 are registered or aligned with the threaded bores 112 defined in the dump stop base 110. A dump stop cover 130 is placed adjacent the shim(s) 120 as shown in FIGS. 1, 2 and 4. The cover 130, shown separately in FIGS. 6A and 6B defines at least one and, as shown herein, first and second bores 133 and counterbores 132 that are located so that they are aligned or registered with the bores 122 of the shim(s) 120 and the bores 112 of the dump stop base 110 when the cover 130 is operably positioned adjacent the shim(s) 120. Bolts or other suitable fasteners 140 are inserted into through the bores 133,122, and threaded into the bores 112 of the dump stop base 110 to secure the shim(s) 120 and the dump stop cover 130 fixedly and operatively to the dump stop base 110. Owing to the presence of the counterbores 132, the heads of the bolts 140 are recessed into the cover 130.

Figure 6A:
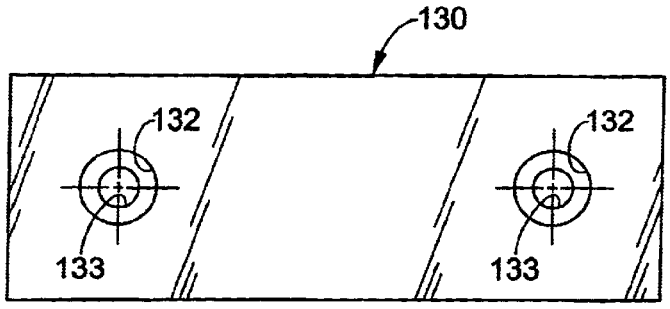
FIGS. 6A and 6B are plan and side elevational views, respectively, of a dump stop cover formed in accordance with the present invention.
Figure 6B:
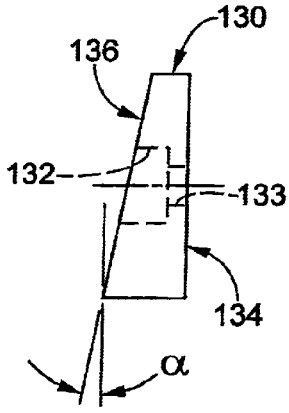

With reference now to FIGS. 6A and 6B, the dump stop cover 130 defines a planar inner face 134 adapted to lie adjacent a shim 120. An opposite, outer face 136 of the dump stop cover is also preferably planar, and is arranged parallel to the inner face 134 (FIG. 4) or angled relative thereto as shown in FIG. 6B by an angle $\alpha$ that is at least 2°, and can vary between 2° and 8° or otherwise as desired. Those of ordinary skill in the art will recognize that, by altering the angle $\alpha$, flush contact between the outer face 136 and an associated arm or other component of a loader or the like can be ensured. Also, the counterbore 132 ensures that heads of the bolts 140 are countersunk into the cover 130 and do not project outwardly beyond the surface 136. The number and/or thickness of the one or more shims 120 controls the distance between the outer surface 136 and the dump stop base 110 to provide an adjustable stop position.

Figure 3:
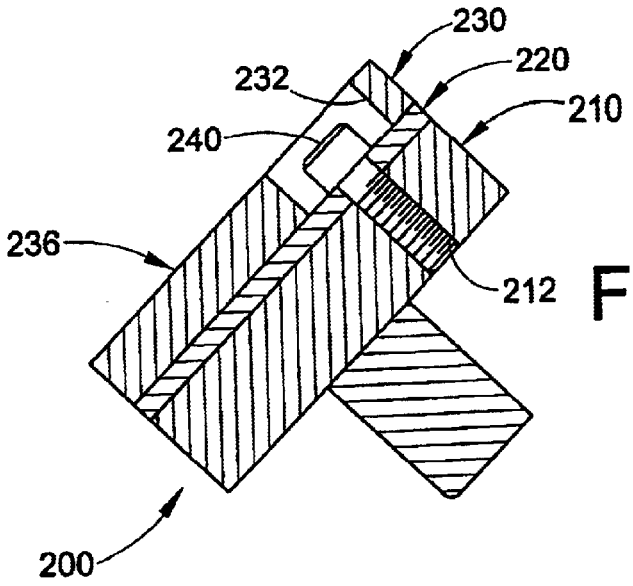
FIG. 3 is a sectional view of a roll-back stop formed in accordance with the present invention as taken along line A—A of FIG. 2.
Figure 7A:
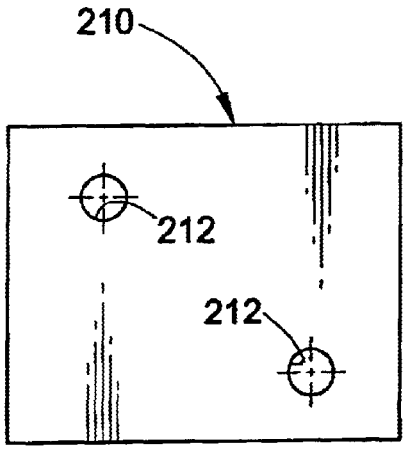
FIG. 7A is a plan view of a roll-back stop base formed in accordance with the present invention.
Figure 7B:
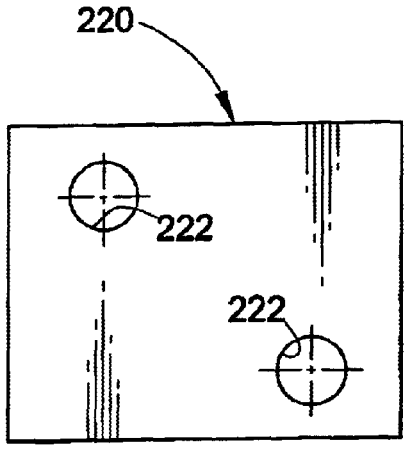
FIG. 7B is a plan view of a roll-back stop shim formed in accordance with the present invention; and, FIGS. 8A and 8B are plan and side elevational views, respectively, of a roll-back stop cover formed in accordance with the present invention.
Figure 8A:
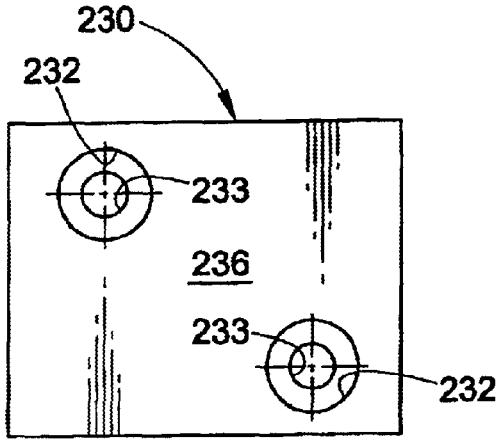
Figure 8B:
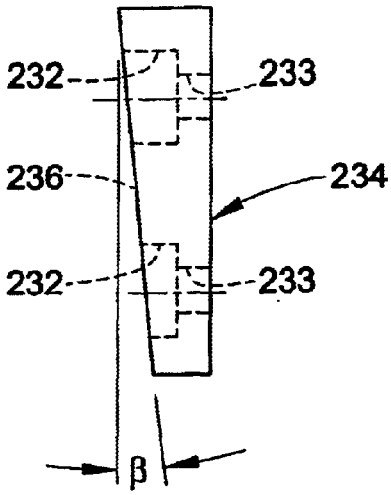

Referring to FIGS. 1 through 3, a roll-back stop 200 formed in accordance with the present invention comprises a roll-back stop base 210 that is welded to or otherwise integral with the coupler 10 or a component thereof. As shown in both FIGS. 3 and 7A, the roll-back stop base 210 defines threaded bores 212. One or more shims 220 (see also FIG. 7B) are placed adjacent the roll-back stop base 210. The shim(s) 220 defines through-bores 222 (not threaded) that are located so that they are aligned or registered with the bores 212 defined in the roll-back stop base 210 when the shim(s) 220 is operatively positioned adjacent the base 210. A roll-back stop cover 230 is placed adjacent the shim(s) 220. The cover 230, as shown in FIGS. 8A and 8B defines at least one and, as shown herein, first and second through-bores 233 and associated counterbores 232 that are located so that they are aligned or registered with the bores 222 of the shim(s) 220 and the bores 212 of the roll-back stop base 210 when the cover 230 is operably positioned adjacent the shim(s) 220. Bolts or other suitable fasteners 240 are inserted into through the bores 232,222, and threaded into the bores 212 of the roll-back stop base 210 to secure the shim(s) 220 and the dump stop cover 230 fixedly and operatively to the dump stop base 210.

With reference now particularly to FIG. 8B, the roll-back stop cover 230 defines a planar inner face 234 adapted to lie adjacent a shim 220. An opposite, outer face 236 of the roll-back stop cover 230 is also planar, and is arranged parallel to the inner face 234 (FIG. 3) or angled relative thereto as shown in FIG. 8B by an angle $\beta$ that is at least 2°, and can vary between 2° and 8° or otherwise as desired. Those of ordinary skill in the art will recognize that, by altering the angle $\beta$, flush contact between the outer face 236 and an associated arm or other component of a loader or the like can be ensured. Also, the counterbore 232 ensures that heads of the bolts 240 are countersunk into the cover 230 and do not project outwardly beyond the surface 236. The number and/or thickness of the one or more shims 220 controls the distance between the outer surface 236 and the rollback stop base 210 to provide an adjustable stop position.

The invention has been described with reference to preferred embodiments. Of course, modifications and alterations will occur to others upon a reading and understanding of the preceding specification. It is intended that the invention be construed as including all such modifications and alterations.

Having thus described the preferred embodiments, what is claimed is:

1. A loader coupler comprising:

first and second dump stops located on opposite lateral sides of the coupler, and first and second roll-back stops located on opposite lateral sides of the coupler, each of said dump and roll-back stops comprising:

a base;

at least one shim located adjacent the base; and, a cover releasably connected to the base, wherein said at least one shim is located between said cover and said base.

2. The loader coupler as set forth in claim 1, wherein said cover defines at least one through-bore and mating counterbore and is releasably secured to said base by a fastener that extends through said at least one through-bore and counterbore, wherein a head of said fastener is located in said counterbore and recessed relative to an outer face of said cover.

3. The loader coupler as set forth in claim 1, wherein said cover includes an inner face in contact with said at least one shim and an outer face disposed opposite said inner face and adapted for contacting an associated arm of an associated loader apparatus, and wherein said inner and outer faces of said cover are parallel to each other.

4. The loader coupler as set forth in claim 1, wherein said cover includes a planar inner face in contact with said at least one shim and a planar outer face disposed opposite said planar inner face and adapted for contacting an associated arm of an associated loader apparatus, and wherein said outer face is arranged at an angle relative to said inner face such that said outer face is not parallel to said inner face.

5. The loader coupler as set forth in claim 4, wherein said angle is at least 2 degrees.

6. The loader coupler as set forth in claim 4, wherein said angle is between 2 and 8 degrees, inclusive.

7. The loader coupler of claim 1, wherein each of said dump and roll-back stops provide an adjustable stop position.

8. The loader coupler of claim 7, wherein at least one of said dump stops and roll-back stop comprises multiple shims locked between said cover and said base.

9. The loader coupler of claim 8, wherein said multiple shims are varying thickness relative to each other.

10. A loader coupler comprising:

first and second dump stops located on opposite lateral sides of the coupler, and first and second roll-back stops located on opposite lateral sides of the coupler, each of said dump and roll-back stops comprising:

a base, a cover releasably connected to said base, and one or more shims disposed between said cover and said base, wherein each of said one or more shims define a thickness, said cover includes an inner face and an outer face oriented opposite said inner face, and each of said dump and roll-back stops provides an adjustable stop position when said cover contacts an associated arm of an associated loader.

11. The loader coupler of claim 10, wherein said stop positions are adjusted by at least one of changing a number of shims disposed between said cover and said base and changing said thickness of at least one of said one or more shims.

12. The loader coupler of claim 11, wherein said outer face of said cover is either parallel to said inner face or angled relative to said inner face by an angle of at least 2°, and said stop positions are further adjusted by changing the angle of said outer face of said cover relative to said inner face.

13. The loader coupler of claim 10, wherein said outer face of said cover is either parallel to said inner face or angled relative to said inner face by an angle of at least 2 degrees.

14. The loader coupler of claim 13, wherein said stop positions are adjusted by changing the angle of said outer face relative to the inner face.

15. A loader coupler comprising:

at least one stop connected to the coupler, said stop comprising:

a base, a cover, and one or more shims disposed between said base and said cover, wherein said cover is releasably connected to said base by at least one fastening means, said fastening means extending through aligned bores defined respectively in said cover and said one or more shims and into bores defined in said base.

16. The loader coupler of claim 15, wherein each of said bores defined in said cover includes a corresponding counterbore and further wherein a head of each of at least one fastening means is located in said counterbore and recessed relative to an outer face of said cover.

17. The loader coupler of claim 15, wherein at least a portion of each of said bores defined in said base is threaded.

18. The loader coupler of claim 15, wherein said cover is relatively connected to said base by threading at least one of said at least one fastening means into said base.

19. The loader coupler of claim 15, wherein said cover includes an inner face in contact with one of said one or more shims and an outer face oriented opposite said inner face, said outer face arranged either parallel to said inner face or at an angle relative to said inner face.

20. The loader coupler of claim 17, wherein said outer face is arranged at an angle of at least 2 degrees relative to said inner face.

* * * * *